US007354493B2

(12) United States Patent
Bauden

(10) Patent No.: US 7,354,493 B2
(45) Date of Patent: Apr. 8, 2008

(54) METHOD AND DEVICE FOR PATENTING STEEL WIRES

(75) Inventor: Jacques Bauden, Lillois (BE)

(73) Assignee: Le Four Industriel Belge, Brussels (BE)

( * ) Notice: Subject to any disclaimer, the term of this patent is extended or adjusted under 35 U.S.C. 154(b) by 530 days.

(21) Appl. No.: 10/516,595

(22) PCT Filed: Jun. 5, 2003

(86) PCT No.: PCT/BE03/00102

§ 371 (c)(1),
(2), (4) Date: Dec. 3, 2004

(87) PCT Pub. No.: WO03/104501

PCT Pub. Date: Dec. 18, 2003

(65) Prior Publication Data

US 2007/0107815 A1 May 17, 2007

(30) Foreign Application Priority Data

Jun. 6, 2002 (BE) ..... 2002/0372

(51) Int. Cl.
*C21D 8/06* (2006.01)

(52) U.S. Cl. ..... 148/595; 266/113

(58) Field of Classification Search ..... 148/595–603, 148/663–644, 320, 636–638; 266/113
See application file for complete search history.

(56) References Cited

U.S. PATENT DOCUMENTS 3,997,376 A 12/1976 Hemsath et al.
4,168,993 A 9/1979 Wilson et al.
4,305,765 A * 12/1981 Wilmotte et al. ..... 134/15
4,570,453 A * 2/1986 Kamio et al. ..... 62/375
5,121,902 A * 6/1992 Jalil et al. ..... 266/106
5,146,759 A * 9/1992 Eguchi et al. ..... 62/64
2004/0244886 A1 * 12/2004 Tsuyama et al. ..... 148/661

FOREIGN PATENT DOCUMENTS

| | | |
|---|---|---|
| BE | 838796 | 6/1976 |
| EP | 0 178 799 A | 4/1986 |
| EP | 0 216 434 A1 | 4/1987 |
| EP | 0 359 279 A | 3/1990 |

(Continued)

*Primary Examiner*—Deborah Yee
(74) *Attorney, Agent, or Firm*—Birch, Stewart, Kolasch & Birch, LLP

(57) ABSTRACT

Disclosed is a method for patenting at least one steel wire, according to which the temperature is increased at least to a level at which the steel austenitizes, followed by quenching in a liquid medium by directing the wire through at least one curtain of cooling liquid so as to obtain a cooling temperature that lies below the austenitizing temperature, the liquid flowing in a turbulent manner substantially perpendicular to the wire, followed by an isothermal stage during which the wire is maintained at a constant temperature allowing pearlitic transformation. The inventive method is characterized by the fact that additionally, a number of successive curtains can be specifically adjusted so as to obtain the temperature which allows pearlitic transformation and is to be kept constant during the isothermal stage as the cooling temperature through the cooling process in a liquid medium, and the isothermal stage immediately follows the cooling process in a liquid medium.

9 Claims, 3 Drawing Sheets

FOREIGN PATENT DOCUMENTS

| | | | |
|---|---|---|---|
| EP | 0 524 689 B1 | | 1/1993 |
| FR | 832.391 | | 1/1975 |
| FR | 2 300 810 A1 | | 9/1976 |
| JP | 404280920 | * | 10/1992 |
| WO | WO-01/73141 A1 | | 10/2001 |

* cited by examiner

METHOD AND DEVICE FOR PATENTING STEEL WIRES

The present invention relates to a method and device for patenting at least one steel wire, comprising a rise in temperature of the said at least one steel wire up to an austenitisation temperature of the steel, an abrupt cooling, in a liquid medium, of the said at least one wire which has reached the said austenitisation temperature, by passing the said at least one wire through at least one cooling liquid curtain in which the latter exhibits a turbulent flow oriented substantially transversely to the said at least one moving wire, with the obtaining of a cooling temperature situated below the austenitisation temperature and above the martensitic transformation temperature, and an isothermal maintenance of the said at least one steel wire at a perlitic transformation temperature up to the end of this transformation.

Cooling baths for wires intended for quenching the steel wires with a view to obtaining a transformation thereof have been known for a long time.

It is possible to cite for example the patenting of steel wires comprising an isothermal quenching, that is to say a rapid cooling of the wires brought at the austenitic temperature into a perlitic formation zone where the wires are maintained more or less isothermally in order to ensure the substantially complete transformation of the austenite.

Methods making use of lead baths or molten salt baths are known in which the wires to be cooled are immersed. These methods, which are very effective, are not acceptable at the present time for reasons of toxicity and hazard to the environment.

Methods are also known making use of aqueous baths. During the immersion in such a bath of water, with laminar non-turbulent flow, a film of vapour forms all around the wires to be cooled (see for example EP-A-0 216 434). This film of vapour is thermally insulating and therefore slows down the cooling.

In order to judiciously control the intensity and speed of the cooling, as well as maintaining the wires in as isothermal a state as possible during their perlitic transformation, it has also been proposed to make the wires pass through several laminar-flow water baths, with on each occasion the formation of a film of vapour around the wires to be cooled and, between various aqueous baths, in alternation a cooling by air, during which the film of vapour disappears (see for example EP-B-0 524 689). Such a method has the drawback of being technically very difficult to apply and to calculate in order to correctly determine when the steel wires have reached the required temperature and how to maintain them approximately at the same appropriate temperature during the perlitic transformation.

Provision has also been made for cooling the wires to be patented by making them pass through a cooling liquid bath and next, as soon as the wires have reached the required temperature, bringing them out of the bath and taking them into a temperature maintenance chamber which is able to move above the cooling bath (see BE-A-838796). It is in this chamber that the perlitic transformation of the steel takes place. The immersion also takes place in a laminar flow bath, which requires the use of expensive or toxic liquids, for example molten salt. Water as a cooling liquid is inapplicable in this method since it is not possible to avoid the formation of films of vapour around the wires to be cooled, whilst passing through the bath.

It should be noted that all these liquid baths according to the prior art require a liquid pumping system, which consumes a great deal of energy.

Finally, a method is known for patenting steel wires which are cooled in 3 successive steps. In the first step, jets of liquid are sprayed at high pressure onto the wires, in a second step a slight gaseous-phase heating is carried out with the addition of external energy, and finally, in the third step, there is an isothermal maintenance of the wires at the temperature regulated by the heating (see BE-A-832391). This method, particularly adapted for wires with very thick cross-sections, therefore requires complex equipment and necessitates expenditure of energy in order to be able to adjust the temperature to be maintained for the perlitic transformation and to put the water jets under high pressure.

The aim of the present invention is to develop a simple and inexpensive method and device which surmount the aforementioned drawbacks and obtain rigorous control over the patenting of the wires.

This problem is resolved according to the invention by a method of patenting at least one steel wire, as described at the start, this method also comprising an adjustment of a number of above-mentioned successive curtains which is determined so as to obtain, by the said cooling in a liquid medium, the said perlitic transformation temperature to be maintained during the isothermal maintenance step, as the above-mentioned cooling temperature, and the above-mentioned isothermal maintenance directly following the cooling in a liquid medium.

This method offers the advantage that the contact between the cooling liquid and the wire is direct, without the possibility of the formation of a film of vapour around the film, a film where the thermal exchange is appreciably less favorable. Given the speed of movement of the wire combined with the speed of flow of each curtain transversely to the direction of movement of the wire, the cooling liquid does not have the time to form a film of vapour around the wire and the liquid/steel wire thermal exchange remains excellent. Simultaneously the method offers the advantage of being able to stop the cooling at any required temperature by a simple determination of the number of curtains necessary. This is particularly important in the case of the patenting of steel wires, where it is necessary to avoid an excessively rapid quenching giving rise to the appearance of martensite in the steel, which is to be avoided in the majority of cases. To this end, a simple adjustment of the number of curtains to be passed through according to the speed of movement of the wire and the flow of the cooling liquid, as well as the diameter of the wire to be cooled, suffices. This adjustment is simple since it suffices to stop the excess curtains or to start up the curtains necessary for reaching the required temperature. Finally, given this possibility of adjusting the temperature by the cooling in a liquid medium according to the invention, the method makes it possible to prevent any cooling or heating in a gaseous medium with the inherent risks of loss of control over the temperature of the wires.

According to one embodiment of the invention, the method comprises spraying of the above-mentioned curtains from the bottom in a rising turbulent flow. The cooling liquid is sprayed under pressure like a continuous and therefore very turbulent geyser. Advantageously, the rising turbulent-flow curtains have a top and the method also comprises, from the said top and at least one side of each rising turbulent-flow curtain, a fall of liquid with turbulent flow through which the said at least one steel wire also passes.

When a geyser of this type is produced, the wire can therefore pass through three successive streams of liquid with turbulent flow, one rising and the other two descending, which makes the ensuing cooling very effective.

According to an improved embodiment of the invention, the method comprises an injection of pressurized gas bubbles in a mass of cooling liquid, in a guided fashion upwards, and an entraining of the said liquid by the said bubbles in the form of the said curtain sprayed in the said rising turbulent flow. Use will preferably be made of a gas which is inert vis-à-vis steel, and in particular air. The pressurized air bubbles entrain the cooling liquid and simultaneously make its flow turbulent, which promotes the require direct thermal exchange. In addition, the upward projection by air bubbles does not require any expensive expenditure of energy and makes it possible to avoid any system for pumping the cooling liquid.

The cooling liquid can be any suitable liquid, water, liquid salt, a polymer, oil, and in particular water, since all the drawbacks encountered by the use of water in the prior art can be surmounted by the method according to the invention.

The method is therefore in the form of a simple method which is easy to control and adjust and makes it possible to consume solely non-polluting and inexpensive materials, that is to say compressed air and cooling water.

Other particularities relating to the method according to the invention are indicated in the claims given below.

The present invention also concerns a device for implementing the method according to the invention. Such a device comprises

- a furnace for austenitising the said at least one steel wire,
- means of driving the said at least one steel wire in movement,
- means of spraying at least one curtain of cooling liquid in which the latter has a turbulent flow oriented substantially transversely to the said at least one moving wire, in order to cool the latter in a liquid medium to the said cooling temperature situated below the austenitisation temperature and above the martensitic transformation temperature, and
- a temperature maintenance chamber for the wires which have reached the said perlitic transformation temperature.

According to the invention, this device also comprises

- means of adjusting the number of successive curtains of cooling liquid to be passed through by the said at least one moving wire in order to reach the said perlitic transformation temperature, by way of cooling temperature, and
- an arrangement of the temperature maintenance chamber directly at the exit from the curtain situated furthest downstream with respect to the movement of the said at least one wire.

According to one embodiment of the device according to the invention, it comprises a tank containing the cooling liquid which is arranged below the said at least one moving wire and means of spraying the above-mentioned liquid curtains in a rising turbulent flow. It is of course possible also to provide a tank arranged above the moving wires and the falling or spraying of cooling liquid curtains from above.

According to an improved embodiment of the invention, the temperature maintenance chamber is mounted so as to be able to move horizontally over the tank according to the number of liquid curtains in service.

Other particularities relating to the device according to the invention are indicated in the claims given below.

Other details of the invention will emerge from the description given below, non-limitingly and with reference to the accompanying drawings.

In the various drawings, identical or analogous elements bear the same reference numbers.

For the description of the various figures reference is made to a water cooling device. This description remains applicable to cooling by any other cooling liquid.

Figure 1:
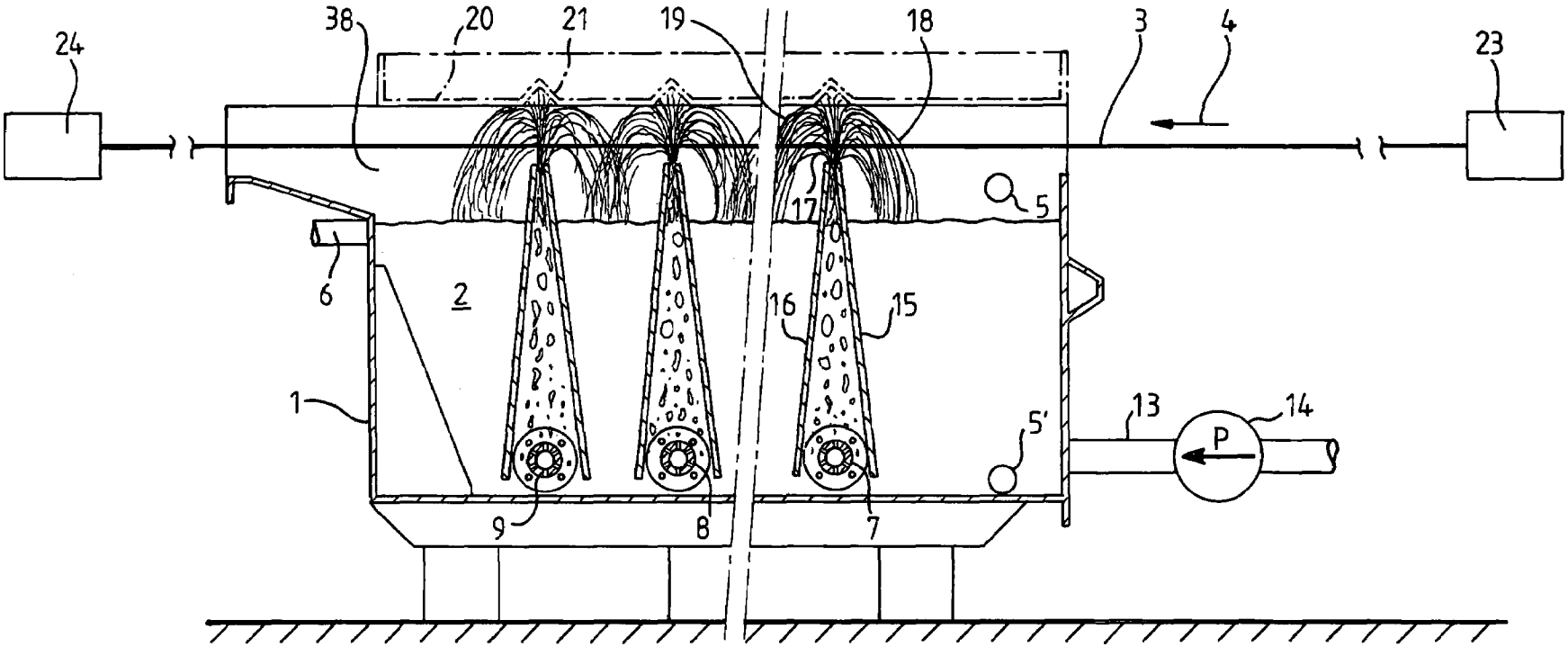
FIG. 1 depicts a view in longitudinal section of a steel wire cooling device to be used in a patenting method according to the invention.
Figure 2:
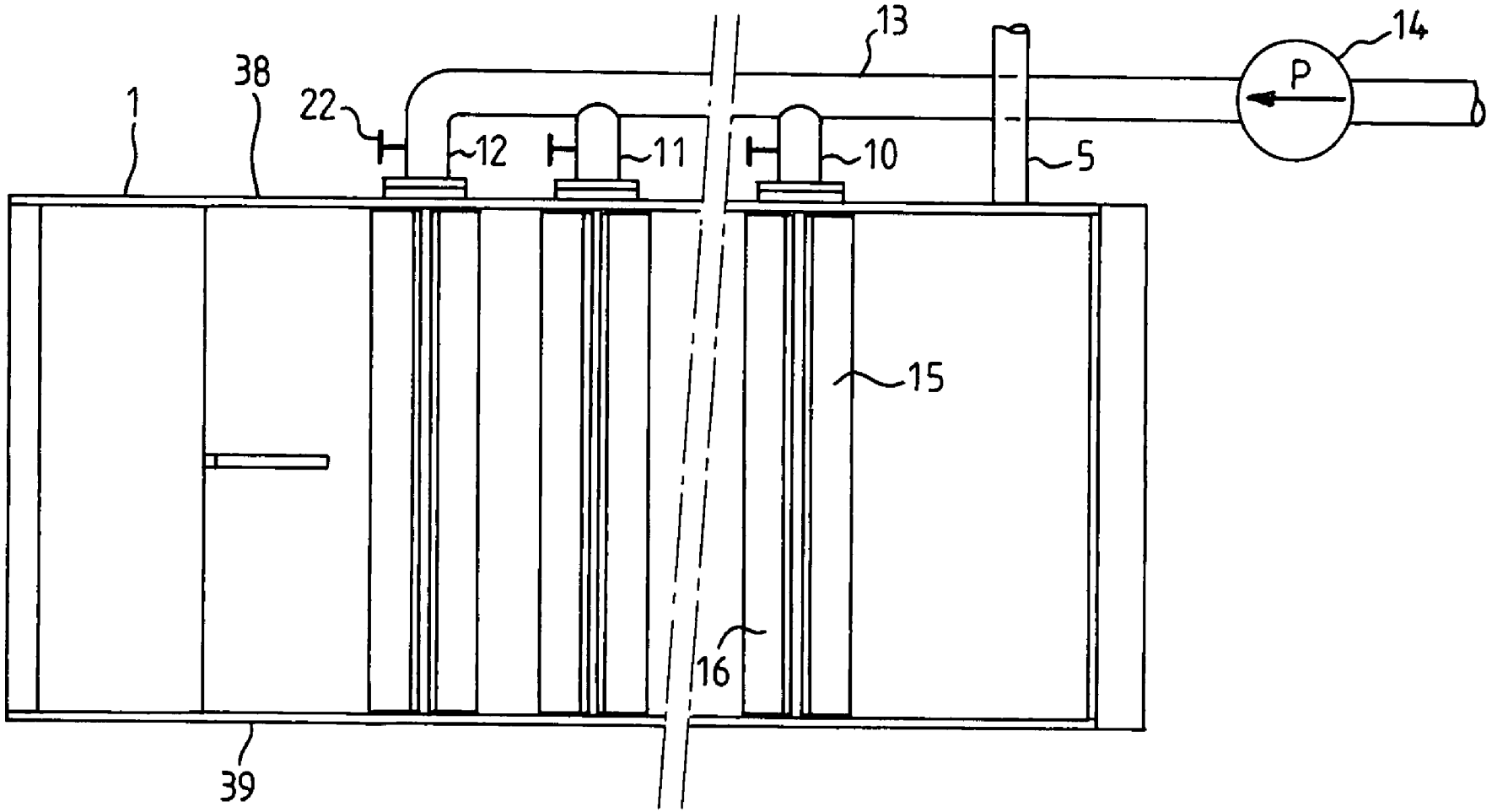
FIG. 2 depicts a plan view of the top of FIG. 1.

FIGS. 1 and 2 depict a tank 1 containing cooling water 2. Above this tank one or more steel wires 3 move in a movement direction indicated by the arrow 4, these wires preferably having a cross-section with a diameter of less than 15 mm. Normal means of driving in movement are depicted schematically by the reference numbers 23 and 24. The water can be supplied through an inlet 5 and be discharged through the top by means of an overflow 6. In the tank illustrated the water column height is equal to approximately 750 mm of H2O (7350 Pa). The overflow 6 can be in communication with a lower inlet 5', by means of a heat exchanger, not shown, so as to put the cooling water in circulation.

The tank also comprises means of spraying rising water curtains. These spray means comprise air supply conduits 7 to 9 disposed at the bottom of the tank parallel to each other and transversely to the direction of movement of the wires. Each of these conduits is connected, through corresponding openings in the tank and by means of couplings 10 to 12, to a distribution conduit 13 supplied with pressurized air by means of a fan 14. On each coupling 10 to 12 there is provided a closure valve 22 which makes it possible to adjust the supply of pressurized air in the conduits 7 to 9 and to put them in or out of service according to requirements.

In the example illustrated, the air supply conduits 7 to 9 are perforated and therefore supply, in the water in the tank, pressurized air bubbles. Above each conduit 7 to 9, two guide plates 15 and 16 are supported by the longitudinal walls 38 and 39 of the tank so as to pass through the latter from side to side. At their top end, situated above the water level, the guide plates are close together and thus form a thin outlet slot. At their bottom end, situated a little lower than their air supply conduit, the guide plates 15 and 16 have an appreciably greater separation than that presented at their top. The guide plates thus form a kind of roof, between the two surfaces of which the bubbles are guided in a forced manner upwards. With an air pressure only slightly greater than the water column, in the case illustrated a pressure of around 1000 mm of H2O (9806 Pa) for example, the air bubbles entrain the water in the tank during their rising and expel a turbulent water curtain 17 upwards. At the top of the water curtain, it can divide into two and form two turbulent waterfalls 18 and 19 which the wire to be cooled must also pass through.

The pairs of guide plates 15, 16 can be arranged in a sufficiently tight manner in their succession so that the waterfalls of two adjoining curtains can intersect. In this way, the wire passes continuously through the water and however there is never a possibility of the formation of a film of water vapour around the wire.

In some cases a cover 20 can be envisaged which closes off the vessel towards the top and which has deflectors 21 for orienting the direction of the waterfalls 18 and 19.

Figure 3:
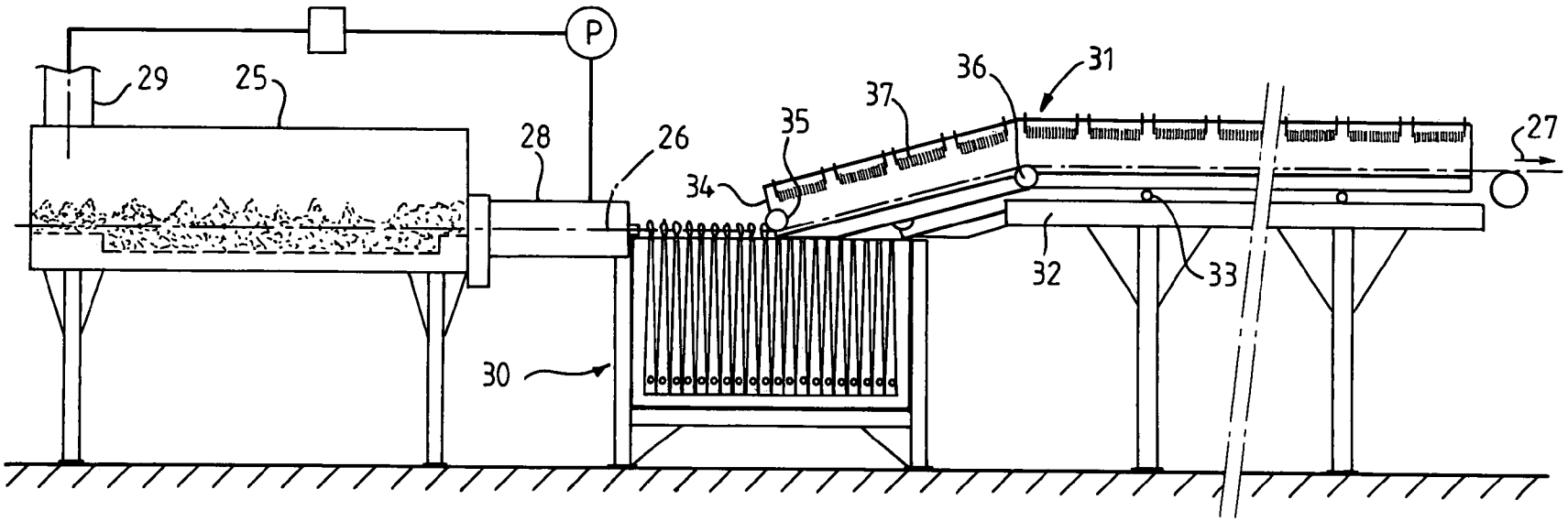
FIG. 3 depicts a schematic view of a steel wire patenting installation implementing the method according to the invention.

FIG. 3 depicts schematically a steel wire patenting installation. This installation comprises, with the cooling of the wires, a unit for heating the wires, for example as described in the patent application WO 01/73141. Here the heating unit consists of a fluidised bed oven 25 in which a layer of wires 26 passes continuously in the movement direction 27. The wires emerge from this oven at an austenitisation temperature, for example approximately 950° C., and then pass through a temperature equalization device 28 where the wire temperature acquired is maintained, in the case illustrated, by a recycling of the burnt gases from the oven 25 through the conduit 29. The dissolution of the carbides (cementite) is carried out in this device 28 and the wires are then passed through the cooling device according to the invention 30.

It will be understood that the heating unit and the temperature maintenance device are not critical according to the invention and that they can be arranged in any suitable manner for obtaining a wire at the austenitisation temperature.

The cooling device 30, arranged for example as provided in FIGS. 1 and 2, allows the formation of several turbulent rising water curtains through which the layer of wires 26 passes, without requiring any diversion of the wires. In the example illustrated, only 10 curtains have been put in service whilst the tank allows the formation of 20 of them.

During the cooling of the steel, it is very important for the temperature of the product corresponding to the required quality to be reached rapidly, if possible before entering the transformation S curves of the steel, which are well known, referred to as TTT (transformation, temperature, time) curves, so that these can be passed through on an isotherm. When the wires illustrated are patented, these are rapidly cooled by the first 10 curtains to a temperature of below the austenitic temperature and above the martensitic temperature, in particular between 500° and 680° C., for example around 580° C.

At this temperature, the wires are situated facing the nose of the S curves, that is to say at a temperature corresponding to the minimum incubation time, in order to pass through these curves, which makes it possible to avoid disturbances which could influence the structure of the steel.

In the example embodiment according to FIG. 3, a temperature maintenance chamber 31 is then provided for the wires which is capable of moving horizontally, for example as described in the Belgian patent BE-A-838796. Here the chamber 31 is supported on a table 32 by rollers 33. Its inlet 34 is brought over the tank 30 and the layer of wires, until just behind the last water curtain brought into service, seen in the direction of movement of the wires. There, by return rollers 35 and 36, the layer of wire is diverted through the chamber 13 which, by means of electrical elements 37 for example, is maintained at the temperature reached by the wires after passing through the last water curtain, for example 580° C. At this moment, given the speed of movement of the wires and the rapid cooling obtained by the thermal exchange with the water curtains, the steel has preferably not yet reached the so-called perlitic transformation S curves. It can then pass through these in an isothermal manner, possibly with a slight spontaneous rise in temperature at the start of transformation, for example up to 600° C., and this out of contact with any cooling liquid and without any intermediate step of cooling or heating in a gaseous medium.

In this way the rapid cooling obtained by the water curtains has been stopped at the required temperature, which is reached according to the number of curtains put in service.

It suffices to decrease or increase the number of curtains to be brought into service, for example if the wires to be treated have a smaller or larger diameter or if their movement is slower or more rapid, for any reason whatsoever.

It must be understood that the present invention is in no way limited to the embodiments described above and that many modifications can be made thereto without departing from the scope of the claims given below.

The invention claimed is:

1. A method of patenting at least one steel wire, comprising the steps of:

heating said at least one steel wire to an austenitisation temperature of steel, ejecting pressurized gas bubbles into a mass of cooling liquid, in a manner which is guided upwards, and entraining said cooling liquid by said bubbles in a form of at least one cooling liquid curtain with an upward turbulent flow, abruptly cooling said at least one wire, in said cooling liquid which has reached austenitisation temperature, by passing said at least one steel wire through said at least one cooling liquid curtain, the at least one cooling liquid curtain exhibiting said upward turbulent flow being oriented substantially transversely to said at least one moving wire, while obtaining a cooling temperature situated below the austenitisation temperature and above a martensitic transformation temperature, adjusting a successive number of the cooling liquid curtains, the number being determined so as to obtain, by the said cooling said wire in said cooling liquid, a perlitic transformation temperature to be maintained during a step of maintaining said at least one wire in an isothermal state, as the cooling temperature; and performing the step of maintaining said at least one steel wire in the isothermal state at the perlitic transformation temperature until completion of a perlitic transformation, wherein the step of maintaining said at least one steel wire in the isothermal state is performed directly following the step of cooling in the cooling liquid.

2. The method according to in claim 1, wherein the upward turbulent flowing cooling liquid curtains have a top, the method also comprising the step of:

passing said at least one steel wire through the cooling liquid curtains as the cooling liquid falls from said top and along at least one side of each of the upward flowing turbulent cooling liquid curtains.

3. The according to claim 2, wherein the falling cooling liquid with the turbulent flow coming from the tops of two successive upward flowing turbulent cooling liquid curtains cross each other at least partially in positions where said at least one steel wire passes.

4. The method according to claim 1, wherein the cooling liquid is water.

5. The method according to claim 1, wherein the wires to be patented have a cross-section with a diameter of less than 15 mm.

6. The method according to claim 1, wherein the pressure of the gas bubbles is greater than a column formed by the mass of cooling liquid.

7. A device for implementing the method according to claim 1, comprising a furnace for austenitising said at least one steel wire, means for driving said at least one steel wire in movement, means for ejecting pressurized gas bubbles into said cooling liquid in a manner which is guided upwardly and for entraining said cooling liquid by said bubbles in the form of the at least one cooling liquid curtain which the latter has a, the upward turbulent flow of the at least one cooling liquid curtain being oriented substantially transversely to said at least one moving wire, in order to cool the at least one moving wire a in the cooling liquid curtains to said cooling temperature situated below the austenitisation temperature and above the martensitic transformation temperature, and a tank containing the cooling liquid and the means of ejecting said pressurized gas bubbles into the cooling liquid, the tank being disposed below said at least one moving wire, means for adjusting a number of successive cooling liquid curtains through which said at least one moving wire passes in order to reach said perlitic transformation temperature, by way of said cooling temperature, a temperature maintenance chamber for the wires which have reached the said perlitic transformation temperature, and wherein the temperature maintenance chamber is arranged directly at an exit from the at least one cooling liquid curtain situated furthest downstream with respect to the movement of said at least one wire.

8. A device according to claim 7, the device further comprising:

deflector means disposed above said at least one moving wire for diverting the upward turbulent flowing cooling liquid curtains towards at least one side of each of the curtains so as to form at least one turbulent flow fall of the cooling liquid through which said at least one steel wire passes.

9. A device according to claim 7, wherein the temperature maintenance chamber is mounted so as to be able to move horizontally over the tank according to the number of liquid curtains in service.

* * * * *